United States Patent [19]

Alsenz

[11] 4,183,223

[45] Jan. 15, 1980

[54] METHOD AND APPARATUS FOR SIGNAL TRANSMISSION IN REFRIGERATION UNITS

[76] Inventor: Richard H. Alsenz, 9720 Town Park, Suite 101, Houston, Tex. 77036

[21] Appl. No.: 873,611

[22] Filed: Jan. 30, 1978

[51] Int. Cl.[2] ..... F25D 21/02

[52] U.S. Cl. ..... 62/80; 62/276; 236/51

[58] Field of Search ..... 62/140, 80, 276; 165/11; 236/51; 219/310 R, 509; 340/151, 538

[56] References Cited

U.S. PATENT DOCUMENTS

| | | | |
|---|---|---|---|
| 3,222,882 | 12/1965 | Sutton, Jr. et al. | 62/140 X |
| 3,838,411 | 9/1974 | Vander Meer | 340/538 X |
| 3,903,508 | 9/1975 | Taketa | 340/310 R |
| 3,972,471 | 8/1976 | Ziegler | 236/51 X |

*Primary Examiner*—William E. Wayner

[57] ABSTRACT

A method and apparatus are disclosed for utilizing existing defrost heater conductors as a transmission medium for high frequency signals generated in response to selected control or alarm information. The signals are detected by a receiver connected to the heater conductors at a location remote from the evaporator coil and adjacent to the defrost heater power contactor. The detected signals are then routed to the various locations for selected control for alarm functions. Among such functions are providing remote readouts of temperature information from the refrigerator cooling section, providing alarm indications in the event of a malfunction within the cooling section resulting in over temperature, and energizing defrost heaters in response to accumulation of frost on the evaporator coil of the refrigeration system on a demand cycle defrost basis.

34 Claims, 1 Drawing Figure

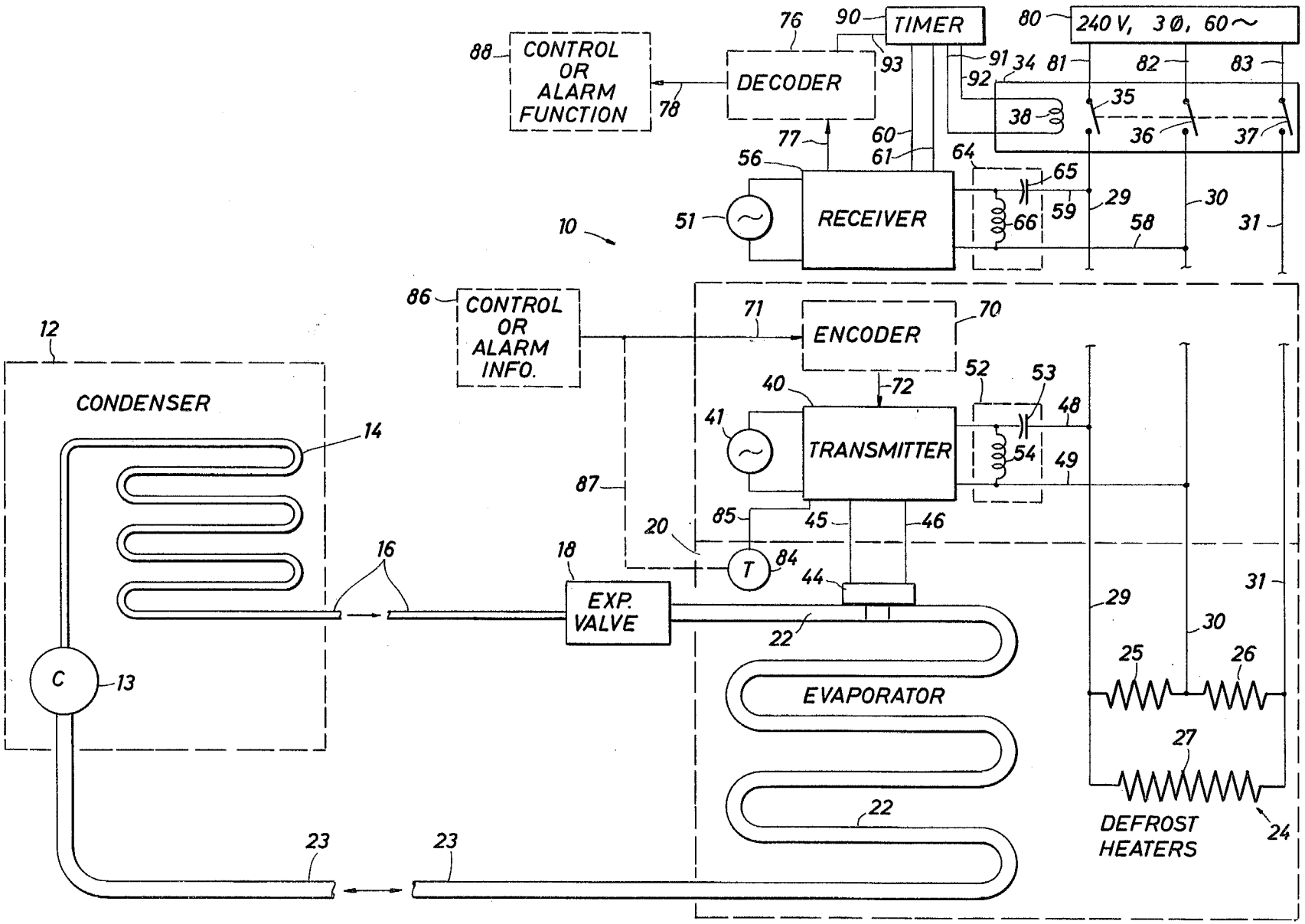
240 V, 3 Ø, 60 ~
TIMER
DECODER
RECEIVER
ENCODER
TRANSMITTER
EVAPORATOR
DEFROST HEATERS
CONTROL OR ALARM FUNCTION
CONTROL OR ALARM INFO.
EXP. VALVE
CONDENSER
C
T

METHOD AND APPARATUS FOR SIGNAL TRANSMISSION IN REFRIGERATION UNITS

BACKGROUND OF THE INVENTION

The present invention relates to methods and apparatus for transmitting selected control and alarm information in the form of high frequency signals using exsting refrigeration system defrost heater conductors as a transmission medium.

In the prior art, conveying selected control or alarm information to locations remote from sensors located within a refrigeration compartment have necessitated conductors be installed between the sensor and the remote location. In large commercial installations, as the number of functions to be monitored increases, the number of conductors increases with installation cableways within which to install the conductors. Further, if additional sensors are to be installed in existing units, space may be limited thus complicating installation of the conductors.

Also in the prior art, various methods must be utilized to periodically reduce the frost build-up on the evaporator coils. Otherwise, the efficiency of the refrigeration system would be decreased by the increasing accumulation of frost. The most common method used with a conventional refrigeration system incorporates a timer mechanism to control a defrost heater power contactor. Typically, the timer mechanism is positioned in proximity to the contactor, which in some refrigerator installations may be located up to 200 feet away from the evaporator section. The timing mechanism periodically applies power to the solenoid coil of the power contactor, closing the switch contacts therein. As the switch contacts are closed, power is applied to the defrost heaters located adjacent to the evaporator coils, with the heat thus generated reducing the frost build-up on the coils. A predetermined time period later, the timer mechanism removes power from the solenoid coil, de-energizing the power contactor and removing power from the defrost heaters.

As power is applied to the defrost heaters, approximately ninety percent of the energy generated by the heaters is absorbed by surrounding structures, such as the refrigeration compartment enclosure, the evaporator coils and the material which is being cooled. Accordingly, only about ten percent of the energy radiated from the heaters is absorbed by and used to reduce the frost build-up on the evaporator coils. During each defrost cycle the defrost heaters are energized and the refrigeration compressor is shut off which results in a waste of most of the electrical power applied to the defrost heater coils, since ninety percent of the dissipated heat is absorbed by the surrounding evaporator and evaporator coil structure without effecting frost removal. In addition, since the refrigeration cycle is shut down, the additional heat added to the evaporator must later be removed b y the refrigeration system, causing added wasting of electrical power during extended refrigerating cycles. Thus, it may be seen that operation of the defrost heaters, although necessary to reduce frost build-up on the evaporator coils, interferes with the proper operation of the refrigeration system. Accordingly, use of the above-described timer mechanism to control power to the defrost heaters is, at best, inefficient since the operation of the mechanism bears no relation to the actual conditions in the system evaporator coil section. These longer compressor and defrost heater operating times result in excess electrical power usage.

More recently, devices designed to be positioned adjacent the evaporator coils and which are used to detect the frost build-up have become available. These devices or sensors produce a signal functionally related to the accumulation of frost on the evaporator coil. This signal is used to initiate a defrost cycle directly related to the accumulation of frost, that is, a "demand" defrost cycle. The use of these devices generally requires that the signal functionally related to the frost build-up be generated by the device and transmitted over electrical conductors supplied for the purpose. The conductors supplied terminate at a timing mechanism similar to that above-described, but which is energized by the transmitted signal. The output of the detection device is functionally related to the build-up of the frost and set to provide a threshold signal which will energize the contactor at a preselected thickness of frost build-up. If such a device is utilized with a new installation, the electrical signal conductors may be positioned during construction. However, in both existing and planned commercial installations, such as the large, commercial refrigeration systems in a super market, the timer mechanism, power main and contactor may be located as much as 200 feet away from the evaporator section. Thus, the additional cost of materials and labor required in installing the additional conductors will be related to the distance between the timer mechanism and the evaporator section. Additionally, if such a device is to be retrofitted on an existing system, the cost of installing the conductors and of materials generally will be higher. Further, in an existing system, space may be limited, thus complicating installation of the conductors.

The present invention overcomes the difficulties of the prior art by providing a method and apparatus for generating high frequency signals containing selected control and alarm information and utilizing the electrical conductors associated with the defrost heaters as a transmission medium for the signals. The apparatus may be either retrofitted to an existing system without requiring additional cabling or readily utilized during the construction of a new refrigeration system.

SUMMARY OF THE INVENTION

The present inventiou provides methods and apparatus for transmitting control and alarm information in the form of high frequency signals over existing refrigeration system defrost heater conductors. A receiver positioned remotely from the evaporator coils of the refrigeration compartment detects the high frequency signals and routes the signals to apparatus for performing the desired control or alarm function. For example, temperature information generated by a temperature sensor positioned within the refrigeration department may be used to generate control signals for controlling a remotely located temperature readout device. Further, signals indicating malfunction off the refrigeration system may be transmitted to alarm indicators remotely located from the system.

According to one embodiment of the present invention, a frost detector is positioned on the evaporator coil section of the refrigeration system. A signal is generated that is functionally related to the frost accumulation on the evaporator coil. The signal thus generated is coupled into a transmitter which, when the signal reaches a first selected level, energizes the transmitter which outputs a preselected high frequency signal containing defrost heater control information. The signal is coupled into a pair of the defrost heater conductors at a point adjacent the evaporator coil section. A receiver is connected to the same pair of defrost heater conductors in a location adjacent a defrost heater power contactor and detects the high frequency signal. The receiver then energizes a timer mechanism which closes the contactor switch contacts therein, thus completing the circuit path between the power main and the defrost heaters. As energy radiates from the heaters, the temperature within the refrigeration compartment elevates. A thermometer or similar temperature sensing device positioned within the compartment develops a signal closely related to the elevation and temperature. This signal can be coupled through the transmitter to the receiver where, when a preselected threshold level is reached, a signal deenergizing the timer mechanism thus generated. When the timer mechanism is deenergized, power is removed from the contactor solenoids allowing the contactor switches to open. This then removes power from the defrost heaters.

Accordingly, it is a feature of the present invention to provide a method and apparatus for transmitting control and alarm information as high frequency signals over existing defrost heater conductors.

It is another feature of the present invention to provide a control information transmission system which is readily adaptable to be retrofitted to existing conventional refrigeration systems without requiring installation of additional signal conductors.

It is a further feature of the present invention to provide a "demand cycle" defrost sub-system using the defrost heater conductors of a conventional refrigeration system as a transmission medium for the "demand cycle" defrost control signals.

These and other features and advantages of the present invention will become apparent from the following detailed description when considered in conjunction with the accompanying drawings.

BRIEF DESCRIPTION OF THE DRAWINGS

In order that the manner in which the above-recited advantages and features of the uinvention can be understood in detail, a more particular description of the invention may be had reference in the specific embodiment thereof which is illustrated in the appended drawing, which drawing forms a part of this specification. It is to be noted, however, that the appended drawing illustrates only a typical embodiment of the invention and, therefore, is not to be considered limiting of its scope when the invention may admit to further equally effective embodiments.

In the drawing:

FIG. 1 is a simplified block schematic of a conventional refrigeration system illustrating the apparatus forming the present invention interconnected to the defrost heater conductors.

DETAILED DESCRIPTION OF THE PREFERRED EMBODIMENT

Referring now to the drawing, a conventional refrigeration system 10, incorporating the present invention, is shown and includes a compressor section 12 having a refrigeration fluid compressor 13 connected to one extremity of a condensor coil section 14. Condensor coil section 14 is connected at its other end to a liquid refrigeration fluid line 16 which is connected to the input port of a refrigeration fluid expansion valve 18.

Refrigeration system 10 further includes an evaporator section 20 having an evaporator coil 22 with one extremity connected to the exhaust port of expansion valve 18 and with the other end connected to a gaseous refrigeration fluid line 23. Refrigeration fluid line 23 is further connected to the input port of compressor 13, thus closing the refrigeration fluid loop.

Also included as part of the conventional refrigeration system 10 is a defrost heater element 24 comprising three resistence heaters, 25, 26 and 27, respectively. Defrost heaters 25, 26 and 27 are connected to switch contacts 35, 36 and 37 of a solenoid-operated power contactor 34 by defrost heater power conductors 29, 30 and 31, respectively. The normally open switch contacts 35, 36 and 37 are also connected by conductors 81, 82 and 83, respectively, to a power main 80 which typically supplies 240 volt, 3 phase, 60 hertz power for operation of the heaters. As shown, resistence heaters 25, 26 and 27 are connected to conductors 29, 30 and 31 in a "delta" configuration.

One practical application of the present invention is to provide defrost heater control signals to energize a timer 90 in response to a frost build-up on evaporator coil 22. The signals are transmitted via defrost heater conductors associated with a conventional refrigeration system. Accordingly, a conventional transmitter 40, connected to a suitable power source 41, is provided as is a frost detector 44 mounted on the evaporator coil section 22 to detect frost build-up. Frost detector 44 provides an output signal functionally related to the frost build-up on the evaporator coil 22. Conductors 45 and 46 couple the detector 44 signal into an input of transmitter 40. When the signal reaches a preselected level, transmitter 40 is energized to provide an output which is coupled into heater conductors 29 and 30 over transmitter conductors 48 and 49, respectively. Although transmitter conductors 48 and 59 are shown connected to heater conductors 29 and 30, it is to be understood that conductors 48 and 49 could be connected to any suitable pair of heater conductors.

Control or alarm information developed by sensors situated at various locations in the refrigeration system and shown as a dashed box 86, generate signals which may be coupled into the transmitter for generation in the high frequency signals transmitted over thx heater conductors. Additionally, such signals may be encoded by using an encoder 70, shown in the drawing as a dashed line, having an input 71 coupling information sensor 86 with encoder 70 which encodes the information for output into the transmitter over conductor 72. Thus, both digital and analog information may be encoded for transmission over the heater conductors.

The present invention makes use of high frequency signals impressed on defrost heater power conductors which, generally, have no other signals impressed thereon. As the defrost heaters are energized for only relatively short periods, and the contactor switches are open at all other times, only the high frequency signal generated in transmitter 40 will, for the most part, be present on the heater conductors. Further, when the switches of the contactor are open, noise or other extraneous signals generated elsewhere will not be able to enter the transmission medium. During those periods when the defrost heaters are energized, the signal frequency is preselected to permit transmission over the heater conductors when the 240 volt defrost heater power is present. Ideally, the preselected frequency of the signal and the low frequency of the power will be non-interfering, one with the other. Further, during this period, protection must be provided to prevent the typical low frequency electrical power from damaging the transmitter 40. Thus, a low frequency filter section 52, such as a series capacitor 53 and a parallel inductor 54, may be utilized in a conventional manner to prevent the low frequency power from heater conductors 29 and 30, from entering the transmitter 40.

A conventional receiver 56, having a suitable power source 51, is positioned adjacent the solenoid operated contactor 34 at a location remote from the evaporator coil section 20 and adjacent the power main 80. Receiver 56 is connected by conductors 58 and 59 to the same heater conductors to which transmitter conductors 48 and 49 are connected. As-shown, receiver conductor 59 is connected to heater conductor 30. The selection of the heater conductors to which the receiver conductors are connected is predetermined by the selection of heater conductors to which the transmitter conductors are connected.

Again, to protect the receiver 56 from damage by the low frequency electrical power typically used to provide power to the defrost heaters, a low frequency filter 64 section, similar to filter section 52, is interposed between the receiver and the connections of the receiver conductors to the heater conductors. Low frequency filter section 64 may also contain a series capacitor 65 and a parallel inductor 66 connected in a conventional manner to prevent the lower frequency power from damaging the receiver.

In the present invention, the receiver is connected to detect the high frequency signal transmitted over the heater conductors and to output electric current over conductors 60 and 61 to energize timer 90. Timer 90 provides power over conductors 91 and 92 to solenoid 38 of contactor 34. When solenoid 38 is thus energized, switches 35, 36 and 37 close to permit the 240 volt electrical power to be applied to defrost heaters 25, 26 and 27.

Additionally, the control or alarm information detected by receiver 56 is output over conductor 77 to the control or alarm functions 88, as shown in a dashed line. If the information is encoded by encoder 70 as above-described, a decoder may be necessary, such as decoder 76, shown in a dashed line. Thus, the digital or analog encoded information is uncoupled from receiver 56 into decoder 76 over conductor 77, with the resultant decoded information being coupled into the control or alarm functions over conductor 78. Additionally, timer control signals, which may have been originally encoded, may be decoded and coupled into timer 90 over conductor 93.

By way of example, the operation of the transmission system will be described in performing a demand defrost function. In operation, a build-up of frost on coils 22 produces a signal output on conductors 45 and 46 which is functionally related to the frost accumulation. Transmitter 40 receives the signal and when a predetermined threshold level is reached, transmitter 40 is energized. When thus energized, a high frequency signal is coupled over conductors 48 and 49 onto heater conductors 29 and 30. The high frequency signal transmitted on heater conductors 29 and 30 is coupled into receiver 56 over conductors 58 aud 59. When receiver 56 detects the high frequency signal, a current signal is coupled through solenoid 38, closing switches 35, 36 and 37. When the contactor switches are closed, electrical power is supplied to the defrost heaters 25, 26 and 27. Heat generated by the resistence heaters removes the frost from the evaporator coil 22. The heat generated by heaters 25, 26 and 27 also increase the temperature within the refrigeration compartment, which is detected by temperature sensor 84. This changing temperature detected by sensor 84 is coupled into transmitter 40 over conductor 85 where it is transmitted as a half-frequency signal on heater conductors to be detected by receiver 56. When the temperature signal reaches a predetermined threshold level, an interrupt signal is coupled from receiver 56 into timer 90 over conductors 60 and 61, removing power from timer conductors 91 and 92. This deenergizes solenoid 39 and allows switches 35, 36 and 37 to open removing power from the defrost heaters. In some instances, particularly where large amounts of control or alarm information are to be transmitted, it may be desirable to encode the temperature signal from sensor 84. Accordingly, the signal is coupled into encoder 70 over conductor 87, shown as a dashed line, and conductor 71. When the signal is detected by the receiver, it is coupled into decoder 76 where the timer interrupt signal is coupled into timer 90 over conductor 93. As above-described, timer interrupt signal removes power from solenoid 38 allowing the contactor switches to open.

Although specific embodiments have been described in detail hereinbefore, it is understood that the subject invention is not limited thereto, and all variations and modifications thereof are contemplated and are included within the spirit and scope of the invention as defined by the appended claims.

What is claimed is:

1. A method of signal transmission in a conventional refrigeration system using the defrost heater conductors as a transmission medium for refrigerator control and alarm signals, comprising the steps of generating high frequency electrical signals functionally related to selected refrigeration system control information, transmitting said high frequency signals over the defrost heater conductors, receiving said transmitted control signals from the defrost heater conductors and causing said control signals to control the selected function of the refrigeration system.

2. The method disclosed in claim 1, including the additional steps of changing said transmitted high frequency signals in response to changes in said selected refrigeration system control informatin, and causing said transmitted high frequency signals in response to changes in said selected refrigeration system control information, and causing said selected control functions to respond to said changes in said control signals.

3. The method disclosed in claim 2, wherein said high frequency signals are generated at a first preselected frequency.

4. The method disclosed in claim 3, wherein said step of changing said electrical signal comprises the step of changing the electrical signal from said first preselected frequency to a second preselected frequency.

5. The method disclosed in claim 2, wherein said high frequency electrical signal is transmitted at a first predetermined signal level.

6. The method disclosed in claim 5, wherein said step of changing said electrical signal comprises the step of changing the signal level from said first to a second preselected level.

7. The method disclosed in claim 2, wherein said step of changing said electrical signal in response to changes in the control information of the refrigeration system comprises terminating said transmission of said high frequency electrical signal.

8. The method disclosed in claim 1, further including the step of electrically isolating said electrical power applied to the heater conductors from the remainder of the refrigeration system.

9. The method disclosed in claim 1, further including the steps of encoding said control information into a high frequency electrical signal, thereafter transmitting said encoded signal over the defrost heater conductors, receiving said encoded signal, and decoding said received encoded signal to retrieve said control and alarm information therefrom.

10. The method disclosed in claim 9, wherein said control information is digitally encoded.

11. The method disclosed in claim 9, wherein said control information is encoded in analog form.

12. A method of energizing defrost heaters in a conventional refrigeration system using the defrost heater conductors as a transmission medium for heater control signals generated in response to frost accumulation on the system evaporation coils, comprising the steps of transmitting a high frequency electrical signal over the defrost heater co-nductors when no electrical power is applied to the heating coils in response to detection of a predetermined frost accumulation on the evaporator coils, and receiving said transmitted electrical signals and applying electrical power to the defrost heaters in response thereto over the defrost heater conductors.

13. The method described in claim 12, including the additional steps of temperature sensing means connected to said signal means and responsive to changes in temperature adjacent the evaporator coils for changing said transmitted electrical signals in a functional relation to said change in temperature, and terminating the application of electrical power to the defrost heaters.

14. The method disclosed in claim 13, further including the steps of encoding said defrost control information into a high frequency electrical signal, thereafter transmitting said encoded signal over the defrost heater conductors, receiving said encoded signal, and decoding said received encoded signal to retreive said defrost control information therefrom.

15. The method disclosed in claim 14, wherein said control information is digitally encoded.

16. The method disclosed in claim 14, wherein said control information is encoded in analog form.

17. The method disclosed in claim 12, further including the step of electrically isolating said electrical power applied to the heater conductors from the remainder of the refrigeration system.

18. Apparatus for signal transmission in a conventional refrigeration system using the defrost heater conductors as a transmission medium for refrigerator control and alarm signals, comprising signal means for generating and transmitting high frequency electrical signals functionally related to selected refrigeration system control information, a pair of defrost heater conductors connected adjacent one extremity to said signal means for receiving said transmitted high frequency signals, a receiver connected to said pair of defrost heater conductors adjacent the remaining extremity for receiving said transmitted control signals from said pair of defrost heater conductors and detecting said selected control information, and control means connected to said receiver for receiving said detected control information and responsive thereto to control the selected function of the refrigeration system.

19. The apparatus disclosed in claim 18, wherein said signal means changes said transmitted high frequency signals in response to changes in said selected refrigeration system control information, and said control means causes said selected control functions to respond to said changes in said control signals.

20. The apparatus disclosed in claim 19, wherein said high frequency signals are generated at a first preselected frequency.

21. The apparatus disclosed in claim 20, wherein said signal means changes said electrical signal from said first preselected frequency to a second preselected frequency.

22. The apparatus disclosed in claim 19, wherein said high frequency electrical signal is transmitted at a first predetermined signal level.

23. The apparatus disclosed in claim 22, wherein said signal means changes said electrical signal from said first to a second preselected signal leval.

24. The apparatus disclosed in claim 19, wherein said signal means changes said electrical signal in response to changes in the control information of the refrigeration system by terminating said transmission of said high frequency electrical signal.

25. The apparatus disclosed in claim 18, further including means interposed between said signal means and receiver and said pair of defrost heater conductors for electrically isolating electrical power applied to the heater conductors from the remainder of the refrigeration system.

26. The apparatus disclosed in claim 18, further including encoding means interposed between the source of said selected control information and said signal means for encoding said control information, and coupling said encoded information into said control means, said signal means thereafter generating and transmitting said control information as an encoded high frequency electrical signal and said receiver thereafter receiving said control information as an encoded high frequency electrical signal, and decoding means interposed between said receiver and said control means for decoding said received encoded signal to retrieve said selected control information therefrom.

27. The apparatus disclosed in claim 26, wherein said encoding and decoding means are digital encoding and decoding means.

28. The apparatus disclosed in claim 26, wherein said encoding and decoding means are analog encoding and decoding means.

29. The apparatus for energizing defrost heaters in a conventional refrigeration system using the defrost heater conductors as a transmission medium for heater control signals generated in response to frost accumulation on the system evaporation coils, comprising signal means for generating and transmitting a high frequency electrical signal over the defrost heater conductors when no electrical power is applied to the heating coils in response to detection of a predetermined frost accumulation on the evaporator coils, a pair of heater conductors connected adjacent one extremity to said signal means for receiving and conveying said transmitted electrical signal, and a receiver connected to the remaining extremity of said pair or heater conductors for receiving said transmitted signals and applying electrical power to the defrost heaters in response thereto over the defrost heater conductors.

30. The apparatus described in claim 29, including temperature sensing means connected to said signal means and responsive to changes in temperature adjacent the evaporator coils for changing said transmitted electrical signals in a functional relation to said change in temperature, and said receiver responsive to said change in said electrical signals for terminating the application of electrical power to the defrost heaters.

31. The apparatus disclosed in claim 30, further including encoding means interposed between said temperature sensing means and said signal means for encoding said temperature change information and coupling said temperature change information into said signal means, said signal means thereafter generating and transmitting said temperature change information as an encoded high frequency electrical signal and said receiver thereafter receiving said temperature change information as an encoded high frequency signal, and decoding means interposed between said receiver and a source of electrical power for decoding said received encoded signals to retrieve said temperature change information therefrom to control the application of electrical power from said source to said defrost heaters over to the heater conductors.

32. The apparatus disclosed in claim 31, wherein said encoding and decoding means are digital encoding and decoding means.

33. The apparatus disclosed in claim 31, wherein said encoding and decoding means are analog encoding and decoding means.

34. The apparatus disclosed in claim 29, further including means interposed between said signal means and receiver and said pair of heater conductors for electrically isolating said electrical power applied from said source to the heater conductors from the remainder of the refrigeration system.

* * * * *